US006275598B1

(12) United States Patent
Bachmann et al.

(10) Patent No.: US 6,275,598 B1
(45) Date of Patent: Aug. 14, 2001

(54) SOUND REPRODUCTION DEVICE

(75) Inventors: Wolfgang Bachmann, Grevenbroich; Gerhard Krump, Schwarzach; Hans-Jürgen Regl, Düsseldorf, all of (DE)

(73) Assignee: Harman Electronic Systems GmbH, Straubing (DE)

( * ) Notice: Subject to any disclaimer, the term of this patent is extended or adjusted under 35 U.S.C. 154(b) by 0 days.

(21) Appl. No.: 09/216,344

(22) Filed: Dec. 18, 1998

(30) Foreign Application Priority Data

Dec. 20, 1997 (DE) ..... 197 57 097

(51) Int. Cl.[7] ..... H04R 25/00

(52) U.S. Cl. ..... 381/425; 381/190; 381/423; 381/424; 181/167; 181/168; 181/170

(58) Field of Search ..... 381/425, 423, 381/424, 426, 427, 428, 190; 181/167, 168, 169, 170

(56) References Cited

U.S. PATENT DOCUMENTS 4,322,583 * 3/1982 Maeda ..... 381/425
4,322,584 3/1982 Shimada et al. .
4,439,640 * 3/1984 Takaya ..... 179/110 A
4,969,197 * 11/1990 Takaya ..... 381/190
5,007,707 4/1991 Bertagni .
5,031,222 * 7/1991 Takaya ..... 381/190
5,445,861 * 8/1995 Newton et al. ..... 428/116
5,702,230 * 12/1997 Kraft et al. ..... 439/119

FOREIGN PATENT DOCUMENTS 2946618 5/1980 (DE) .
3907540 12/1989 (DE) .

* cited by examiner

*Primary Examiner*—Sinh Tran
*Assistant Examiner*—Dionne N. Harvey
(74) *Attorney, Agent, or Firm*—Ware, Fressola, Van Der Sluys & Adolphson LLP

(57) ABSTRACT

The invention presents a sound reproduction device which operates in accordance with the flexural wave principle. Such devices have in common that a panel 10 is provided in which flexural waves are produced by a drive arrangement 16. The drive arrangements 16 in the state of the art are connected to one of the surfaces of the panel 10 and are held by a support structure which functions as a countersupport. Such support structures either hinder the propagation of the flexural waves along the surface of the panel 10 and/or lead to an increase in the constructed depth of such a sound reproduction device. To avoid these disadvantages of the state of the art, the drive system 16 is located in a cutout 15 of the panel 10. This not only has the additional advantage that the appearance of both surfaces of the panel 10 can be standardized, but also that by weakening the panel 10 in the area of cutout 15, the output for the production of flexural waves is reduced, or that the same output can be used to produce the oscillations required for bass sound reproduction.

11 Claims, 2 Drawing Sheets

SOUND REPRODUCTION DEVICE

CROSS-REFERENCE TO RELATED APPLICATIONS

This patent application discloses subject matter that is disclosed and may be claimed in copending U.S. patent applications having Ser. Nos. (Atty. Docket Nos. 915.328 and 915.329), both filed on even date herwith.

TECHNICAL FIELD

The invention concerns the arrangement of drive systems in sound reproduction devices that operate in accordance with the flexural wave principle.

BACKGROUND OF THE INVENTION

Sound reproduction devices that operate in accordance with the flexural wave principle are known in the state of the art. Such arrangements are essentially composed of a panel and at least one drive system, where the panel begins to oscillate when sound signals are conducted to the drive system(s). It is characteristic for such sound reproduction devices that a "flexural wave radiation" starts at a critical lower cut-off frequency, where the flexural waves lead to sound being radiated in a frequency-dependent direction along the plane of the respective panel. In other words, a cut through a directivity diagram shows a principal lobe whose direction if frequency-dependent. These relations apply fully to infinitely expanded plates and absorber plates, while the relations for the multiresonance plates treated in this application are clearly more complex because of the strong edge reflexes. This multiresonance plate complexity is due to the fact that the mentioned principal lobe has a number of such principal lobes superimposed on it in a frequency-dependent direction, so that a fan-shaped directivity diagram is created which furthermore is very frequency-dependent. But the multiresonance plates and the absorber plates treated here have in common that the center of their directivity diagram rather points away from the mid-perpendicular. This characteristic allows the room to have a greater effect on the sound wave projection.

The panel is built in accordance with the sandwich principle, where each of two opposite surfaces of a very light core layer are connected to a thin cover layer, for example by means of an adhesive. For the panel to have good sound reproduction properties, the material for the cover layer must have an especially high dilatational wave speed. Suitable cover layer materials are for example thin metal foils or fiber-reinforced plastic foils as well.

The core layer must fulfill special requirements as well. Thus it is necessary for the materials being used to first have a low mass density and low damping. In addition, the core layer materials must have as high a vertical shear modulus as possible with respect to the surfaces that are provided with the cover layers. Finally in the sense of a principal requirement it is necessary for the materials that can be used for the core layers to have a very low modulus of elasticity in the direction in which the subsequently formed core layer has its greatest expansion. These two premises, which at first seem contradictory in reference to the last two requirements, are better fulfilled by a core layer which has a perforated structure with openings of a preferably small cross section extending between the two surfaces to be covered by the cover layers. In addition to the core layers with the perforated structure, hard foams can also be used as the core layer material because these materials have suitable shear and elasticity moduli despite their isotropic properties. In this connection we should not forget to also mention that when hard foams are used as the material for the core layer, the objective of the cover layers is to provide the required anisotropic behavior of the panel.

In order to radiate sound waves by means of a panel as described above, it is necessary to connect the panel to a drive system which produces wave-shaped deformations in the panel that are vertical to the plane of the cover layers. To achieve this the state of the art generally uses magnet systems which are also used for driving conventional loudspeakers. In order for these drive systems to provide the deformation of the panel which is necessary to radiate flexural waves, the drive systems are usually equipped with a corresponding countersupport. This countersupport can for example be formed by a supporting structure which is located away from one of the two cover foils and receives the drive system. Aside from the fact that such a supporting structure not only increases the constructed depth and the weight of such installations, this kind of supporting structure also requires considerable production costs. For that reason the supporting structures which function as a countersupport for the drive systems are now directly connected to the panel. A disadvantage however is that the supporting structures which are connected to the panel impede the generation of flexural waves in the panel and lead to a distorted sound reproduction. This can be attributed to the fact that by comparison with a pure drive system, the attachments required to fasten such supporting structures to the panel stiffen large areas of the panel which extend in the direction of the greatest expansion. It is additionally disadvantageous in such supporting structures that they do not fulfill the properties required by the cover layers and the core layer.

It is therefore the objective of the invention to present a sound reproduction device which eliminates the disadvantages of the state of the art.

SUMMARY OF THE INVENTION

This objective is achieved by a sound reproduction device with a panel essentially composed of a core layer as well as a top and a bottom cover layer, where opposite surfaces of the two cover layers cover opposite surfaces of the core layer, and with a drive arrangement which is connected to the panel and makes it oscillate under the effect of sound signals, wherein the core layer has a cutout, and that the drive arrangement is exclusively integrated into this cutout.

The basic idea of the invention is to provide the panel with a cutout, and to locate the drive system in this cutout. If the sound reproduction device is built in this manner, the core layer itself can be used as countersupport for parts of the drive system. In addition to the savings in weight and construction depth, this also has the advantage that due to the drive system's full integration into the panel, the two surfaces provided with the cover layers can be constructed in a uniform manner. Furthermore, panels in which the drive systems are fully integrated, or which are separated from the environment by the cover layer or layers, can also be used in areas subjected to dirt or humidity without any problems. Finally the area of the panel that is weakened by the cutout causes a particularly good impression of flexural waves in the panel, so that the output required to achieve the flexural wave can be reduced, or the same output can produce the panel oscillations that are required for bass sound reproduction.

Particularly good transmission is achieved in the bass and middle range areas if the drive system is composed of at least one permanent magnet, a voice coil support and a voice coil.

The construction of a sound reproduction device is particularly simple if the core layer has a honeycomb structure where each honeycomb is formed of a number of walls extending between the two cover layers. By locating the cutout in the core layer, the walls of one or of several honeycombs are laid open and in this case it is possible to use them as voice coil supports. It should already be pointed out here that the use of the core layer as the voice coil support is not limited to the honeycomb structure. Rather the walls of circular or polygonal structures that form the core layer, and the walls which are formed by placing a cutout in a core layer of hard foam, can be used in the same manner.

The construction is further simplified if the permanent magnet or magnets are connected directly or by means of holders to the core layer, and the areas of the core layer which are directly connected to the permanent magnet or magnets or the holders have a diameter D1 that is larger than the diameter D2 of the voice coil. It should already be pointed out here that the relationship between the two diameters D1 and D2 has a decisive significance for the tuning of the panel. Modifications of the diameter D2 are particularly significant because they result in impedance changes and thus affect the modular amplitudes as well.

The invention is not restricted to the use of electromagnetic drive systems. Rather piezoelectric drive systems can also be used when higher frequency sound signals must be transmitted. To obtain a piezoelectric drive system it is sufficient if only one piezoelectric disk is located in the bottom of the cutout.

If the drive system is achieved with one disk of piezoelectric material, the side of the piezoelectric disk that faces away from the bottom must be provided with a seismic mass to enable it to receive counteracting forces.

To achieve a particularly good power impression in the panel, the bottom of the cutout can be equipped with a pressure plate.

To improve the power impression of the panel, the honeycombs which abut axially and radially against the cutout are filled with a plastic foam material.

BEST MODE FOR CARRYING OUT THE INVENTION

The invention will now be explained in greater detail by means of the figures.

Figure 1:
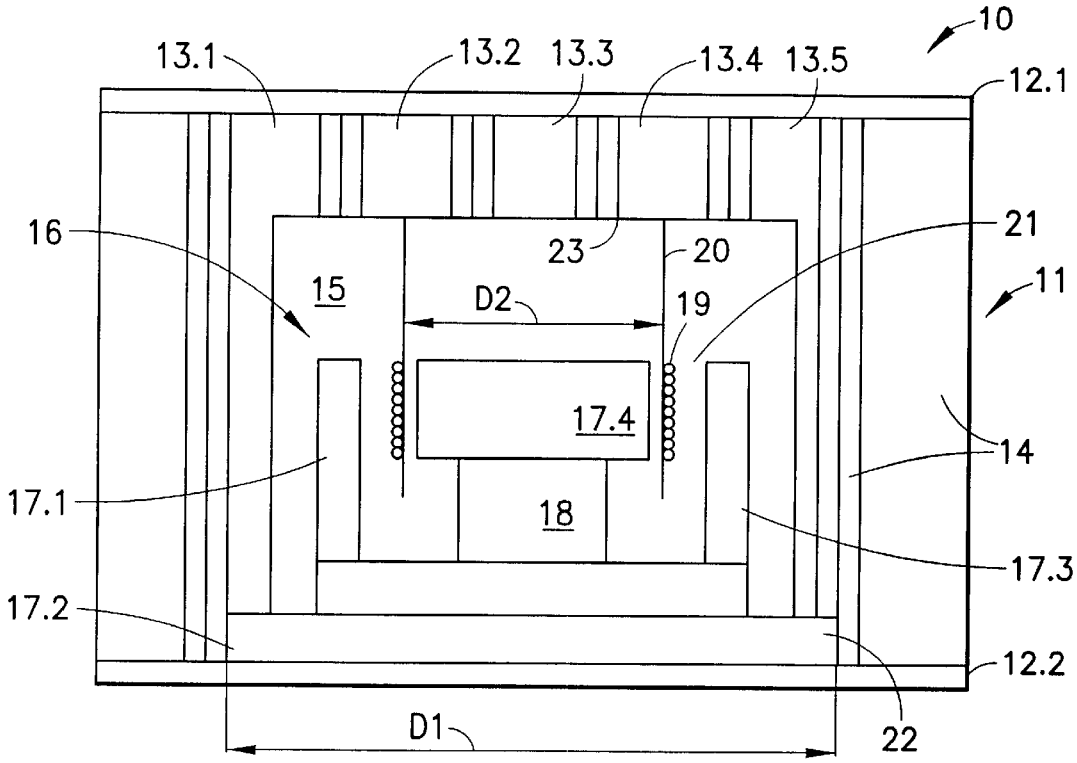
FIG. 1 is a cut through a panel.

FIG. 1 illustrates a lateral view of a cutout in a panel 10. This panel 10 is composed of a core layer 11, a top cover layer 12.1 and a bottom cover layer 12.2. In this case the two cover layers 12 are connected to opposite sides of the core layer 11. As is the case in all the other embodiments, this embodiment also has a honeycomb structured core layer 11, where each of these honeycombs 13 has a hexagonal cross section. The walls 14, which are laterally interconnected and form the respective honeycombs 13, extend between the two cover layers 12. For reasons of completeness alone it should be pointed out that all the embodiments illustrated in this application also apply to core layers 11 which are made of hard foam.

A cutout 15 is milled into the side of the core layer 11 that is connected to the bottom cover layer 12.2. A drive system 16 is located in this cutout 15. This drive system 16 is composed of a so-called rear yoke arrangement 17.1–17.4, a permanent magnet 18 and a voice coil support 20 equipped with a voice coil 19. In that case the parts of the rear yoke arrangement 17.1–17.3 form a rear yoke pot. The permanent magnet 18 and the part 17.4 are placed into the rear yoke pot formed of parts 17.1–17.3. In addition the unit composed of the permanent magnet 18 and the parts of the rear yoke arrangement 17.1–17.4 has an air gap 21, into which the voice coil support 20 equipped with the voice coil 19 can dip. Furthermore there is a holder 22 which is connected to part 17.2 of the rear yoke arrangement and to the core layer 11.

The function of the sound reproduction device 10 does not require the holder 22 to be covered by the bottom cover layer 12.2 as illustrated in FIG. 1. If the holder 22 in the area of the bottom cover layer 12.2 is omitted in another not illustrated embodiment, it can also be used as a cooling plate for the drive system 16 if it has good heat conductivity. To that end the holder 22 which operates as a cooling plate can also be equipped with cooling ribs (not shown).

As further shown by the dotted line in FIG. 1, the honeycombs 13.1–13.5 which are directly adjacent axially and radially to the cutout, are filled with a plastic foam material. This improves the stability of the arrangement in the drive system 16 area. Good power insertion is additionally assured by filling the honeycombs 13.2 and 13.4 with foam, since the voice coil support 20 is coupled to the core layer 11 in the area of said honeycombs 13.2 and 13.4. For reasons of completeness alone it should be pointed out that in another not illustrated embodiment, the bottom 23 of the cutout 15 can still be equipped with a pressure plate 25 even if the honeycombs 13.2 and 13.4 are filled with foam.

Figure 2:
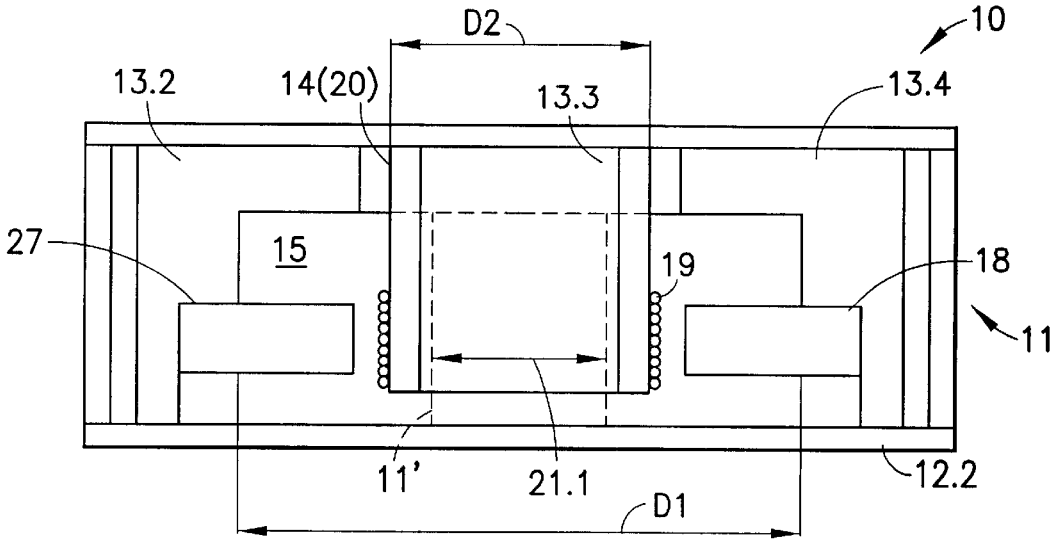
FIG. 2 is a cut through a further panel.

As compared to FIG. 1, FIG. 2 illustrates a greatly simplified sound reproduction device 10. In this embodiment the drive system 16, which is located in the cutout 15, is only formed of a circular permanent magnet 18 and a voice coil 19. The permanent magnet 18, which by contrast to the permanent magnet 18 in FIG. 1 is magnetized radially with respect to the shown center line, is directly connected to the core layer 11. To save a voice coil support (20), the voice coil 19 is directly connected to the (outer) walls 14 of honeycomb 13.3 which were not milled out with the cutout 21, and dips together with the walls 14 of honeycomb 13.3 into the recess 21.1 of circular permanent magnet 18.

In this embodiment as well for reasons of stability the honeycombs 13.2–13.4 are filled with plastic foam material (shown by a dotted line). To prevent damage to the bottom cover layer 12.2 during operation of the panel 10, the bottom cover layer 12.2 can furthermore be supported against the bottom 23 of cutout 15 by a spacer block 11', where this spacer block 11' can also be formed by the core layer 11.

To obtain an especially good power impression in the core layer 11 or in the panel, the areas of the core layer 11 which are closest to the voice coil support 20 in the radial direction and are connected to the permanent magnet 18, have a diameter D1 which in this embodiment corresponds to twice the diameter D2 of the voice coil support 20 or the voice coil 19.

Figure 3:
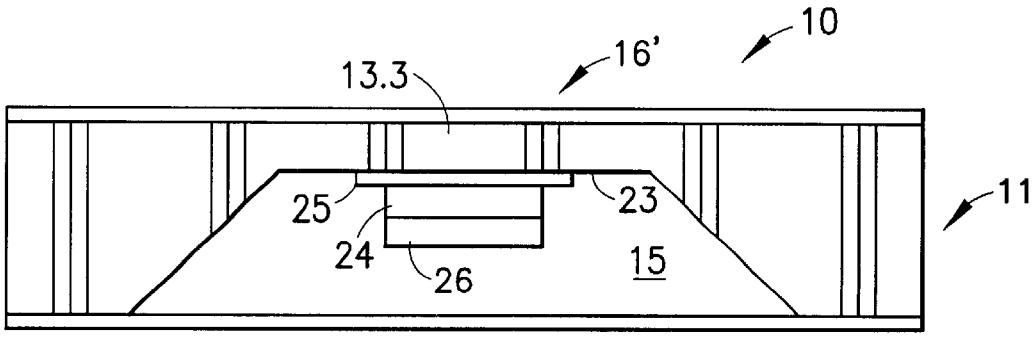
FIG. 3 is a cut through a further panel.

FIG. 3 illustrates a sound reproduction device 10 wherein a piezoelectric drive system 16' is located in the cutout 15. The drive system 16' is composed of a disk 24 of piezoelectric material, a pressure plate 25 and a seismic mass 26. In that case the pressure plate 25 is directly connected to the bottom 23 of the cutout 15. The disk 24 of piezoelectric material is attached to the side of the pressure plate 25 that faces away from the top cover layer 12.1. The seismic mass 26 is connected to the side of the disk 24 that faces away from the pressure plate 25.

It is not important for the sound reproduction devices under consideration whether the disk 24 is designed as a so-called flexural or thickness vibrator, although the so-called flexural vibrators, in addition to their lower weight and greater amplitude, are much better suited for the application under consideration with respect to their impedance.

Deviating from the other embodiments, only the honeycomb 13.2 of the embodiment in FIG. 3 is filled with foam (indicated the dotted line).

For reasons of completeness alone it should be pointed out that in an arrangement as illustrated in FIG. 3, the disk 24 of piezoelectric material can also be connected to the core layer 11 without any intermediate pressure plate 25, if the core layer 11 and/or the foam being used has sufficient stability.

Insofar as an increase in loudness is desired with the simultaneous loss of broadband status of the drive arrangement 16' shown in FIG. 3, the disk 24 can also be used without the seismic mass 26.

Figure 4:
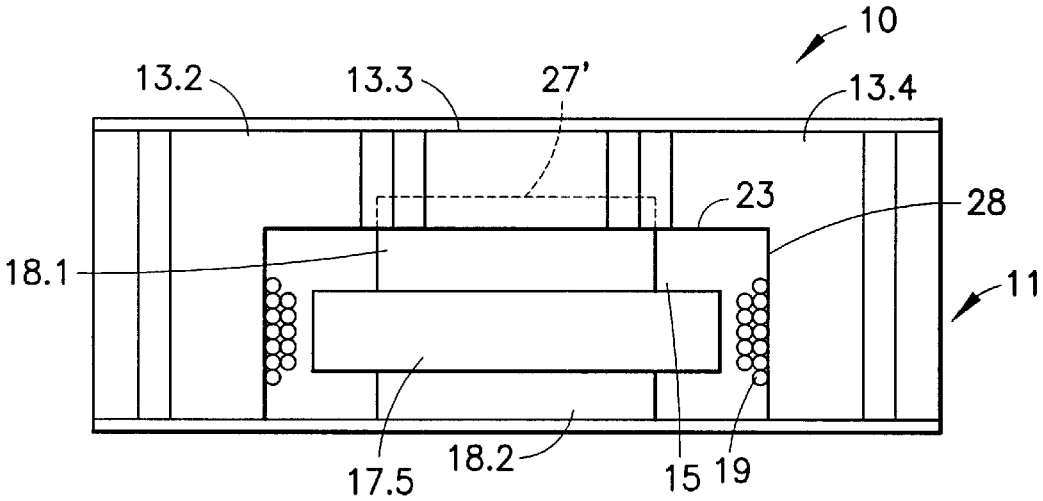
FIG. 4 is a cut through a further panel.

FIG. 4 illustrates a similar embodiment to that of FIG. 1. Only the configuration of the drive system 16 which is located in the cutout deviates therefrom. It is composed of two permanent magnets 18.1, 18.2, a rear yoke plate 17.5 and a voice coil 19. The two permanent magnets 18.1, 18.2, which like the permanent magnet 18 in FIG. 1 are magnetized in the direction of the indicated center line, are connected to the rear yoke plate 17.5 on two opposite sides. The permanent magnet 18.1 is attached to the bottom 23 of the cutout 15.

Since equal poles (N or S) of the two permanent magnets 18.1, 18.2 point in opposite directions with respect to the center line, a magnetic drive system 16 is simulated and corresponds to the permanent magnet 18 of FIG. 2 which is magnetized in the radial direction.

However, in contrast to the configurations of FIGS. 1 and 2, the voice coil 19 of FIG. 4 is not connected to the bottom 23 of the cutout 15, but to the lateral surfaces 28 which delimit the cutout 15 in the radial direction and are formed by the indicated dotted foam fill.

If necessary, a separate voice coil support 20 can also be placed between the lateral surface 27 and the voice coil 19 in another not illustrated embodiment. This also implies that such a voice coil support 20 is made of walls 14 which form honeycombs 13, similar to FIG. 2.

As made clear by FIGS. 2 and 4, the cutout 15 can also be used for the reciprocal centering of voice coil 19 and magnet system 17; 18 if the cutout 15 is equipped with corresponding steps 27. Since the voice coil support 20 in the embodiment of FIG. 2 is formed by the wall 14 of honeycomb 13.3 by leaving this honeycomb 13.3 standing when the cutout was milled out, the correct reciprocal arrangement of voice coil support 20 or voice coil 19 with the permanent magnet 18 is provided automatically when the final position of the latter is on step 27 of the cutout 15 as shown in FIG. 2. If the embodiment in FIG. 4 is also to be used for centering the voice coil 19 and the magnet system 17; 18, the bottom 23 must be provided with a step 27' (illustrated by a dotted line) which can be engaged by the permanent magnet 18.1 when the magnet system 17, 18 has reached its final position in cutout 15.

What is claimed is:

1. A sound reproduction device comprising a panel (10) essentially composed of a core layer (11) as well as a top and a bottom cover layer (12.1, 12.2), where opposite surfaces of the two cover layers (12) cover opposite surfaces of the core layer (11), and a drive arrangement (16) which is connected to the panel (10) and makes it oscillate under the effect of sound signals, wherein the core layer (11) has a cutout (15), the drive arrangement (16) is exclusively integrated into this cutout (15) and the drive arrangement (16) is composed of at least one permanent magnet (18), a voice coil support (20) and a voice coil (19).

2. A sound reproduction device as claimed in claim 1, characterized in that the core layer (11) has a honeycomb structure, where each honeycomb (13) in this structure is formed of a number of laterally connected walls (14) extending between the two cover layers (12), and that the voice coil support (20) is formed by the walls (14) of the honeycombs (13) that form the core layer (11).

3. A sound reproduction device as claimed in claim 2, characterized in that the permanent magnet or magnets (18) are connected directly to the core layer (11) or by means of holders (22), and that the areas of the core layer (11) which are in direct contact with the permanent magnet or magnets (18) or with the holders (22) have a diameter (D1) that is larger than the diameter (D2) of the voice coil (19).

4. A sound reproduction device as claimed in claim 1, characterized in that the permanent magnet or magnets (18) are connected directly to the core layer (11) or by means of holders (22), and that the areas of the core layer (11) which are in direct contact with the permanent magnet or magnets (18) or with the holders (22) have a diameter (D1) that is larger than the diameter (D2) of the voice coil (19).

5. A sound reproduction device as claimed in claim 1, characterized in that at least the honeycombs (13) of the core layer (11) which abut axially and radially against the cutout (15), are filled with a plastic foam material.

6. A sound reproduction device comprising a panel (10) essentially composed of a core layer (11) as well as a top and a bottom cover layer (12.1, 12.2), where opposite surfaces of the two cover layers (12) cover opposite surfaces of the core layer (11), and a drive arrangement (16) which is connected to the panel (10) and makes it oscillate under the effect of sound signals for reproducing sound, wherein the core layer (11) has a cutout (15), the drive arrangement (16) is exclusively integrated into this cutout (15), and the drive arrangement (16) is composed of a piezoelectric disk (24) which is connected to the bottom (23) of the cutout (15) so as to eliminate the need for a supporting structure which would have to be connected to the panel (10) and might impede the generation of flexural waves in the panel and might cause a distortion in sound reproduction.

7. A sound reproduction device as claimed in claim 6, characterized in that at least the honeycombs (13) of the core layer (11) which abut axially and radially against the cutout (15), are filled with a plastic foam material.

8. A sound reproduction device comprising a panel (10) essentially composed of a core layer (11) as well as a top and a bottom cover layer (12.1, 12.2), where opposite surfaces of the two cover layers (12) cover opposite surfaces of the core layer (11), and a drive arrangement (16) which is connected to the panel (10) and makes it oscillate under the effect of sound signals, wherein the core layer (11) has a cutout (15), the drive arrangement (16) is exclusively integrated into this cutout (15), the drive system (16) is composed of a piezoelectric disk (24) connected to the bottom (23) of the cutout (15), and a seismic mass (26) is located on the side of the piezoelectric disk (24) which faces away from the bottom (23) of the cutout (15).

9. A sound reproduction device as claimed in claim 8, characterized in that the bottom (23) of the cutout (15) has a pressure plate (25).

10. A sound reproduction device as claimed in claim 9, characterized in that at least the honeycombs (13) of the core layer (11) which abut axially and radially against the cutout (15), are filled with a plastic foam material.

11. A sound reproduction device comprising a panel (10) essentially composed of a core layer (11) as well as a top and a bottom cover layer (12.1, 12.2), where opposite surfaces of the two cover layers (12) cover opposite surfaces of the core layer (11), and a drive arrangement (16) which is connected to the panel (10) and makes it oscillate under the effect of sound signals for reproducing sound, wherein the core layer (11) has a cutout (15), the drive arrangement (16) is exclusively integrated into this cutout (15) and the bottom (23) of the cutout (15) has a pressure plate (25) wherein the drive arrangement is connected to the bottom of the cutout (15) so as to eliminate the need for a supporting structure which would have to be connected to the panel (10) and might impede the generation of flexural waves in the panel and might cause a distortion in sound reproduction.

* * * * *

UNITED STATES PATENT AND TRADEMARK OFFICE

CERTIFICATE OF CORRECTION

PATENT NO. : 6,275,598 B1
DATED : August 14, 2001
INVENTOR(S) : Bachmann et al.

It is certified that error appears in the above-identified patent and that said Letters Patent is hereby corrected as shown below:

Column 8, claim 11,
Line 2, after "(15)" -- , -- should be inserted.

Signed and Sealed this

Fifth Day of March, 2002

*Attest:*

*Attesting Officer*

JAMES E. ROGAN
*Director of the United States Patent and Trademark Office*